United States Patent [19]

Battocletti

[11] Patent Number: 4,962,649

[45] Date of Patent: Oct. 16, 1990

[54] ENERGY CONSERVING REFRIGERATED FIXTURE

[76] Inventor: Bart Battocletti, #4 Mike Allen, Washington, Mo. 63090

[21] Appl. No.: 419,373

[22] Filed: Oct. 10, 1989

[51] Int. Cl.[5] ..... A47F 3/04

[52] U.S. Cl. ..... 62/256; 62/408; 98/36

[58] Field of Search ..... 62/256, 255, 408, 418; 98/36; 312/297

[56] References Cited

U.S. PATENT DOCUMENTS

| | | | |
|---|---|---|---|
| 1,986,022 | 1/1935 | Stahl | 312/292 X |
| 2,558,997 | 7/1951 | Voelker | 62/255 X |
| 2,597,267 | 5/1952 | Shoemaker et al. | 312/297 X |
| 2,827,118 | 3/1958 | Wendt | 312/297 x |
| 4,379,391 | 4/1983 | Rhee | 62/256 X |
| 4,402,192 | 9/1983 | Henry | 62/256 |
| 4,432,591 | 2/1984 | Rinkewich | 312/297 |

*Primary Examiner*—William E. Tapolcai

[57] ABSTRACT

A refrigerated fixture which has an opening for enabling access to the interior of the fixture, the fixture includes a pair of arcuate track members adapted to be mounted in contact with the opening and a side of the fixture, a sectional door mounted between and in the track members for sliding movement between a closed position and an open position. The fixture also includes an evaporator coil for providing refrigerated air, a fan for circulating the refrigerated air, a nozzle disposed around the opening of the fixture, and a switch which when contacted by the door operates the fan for circulating the refrigerated air to be discharged through the nozzle into the opening.

16 Claims, 2 Drawing Sheets

ENERGY CONSERVING REFRIGERATED FIXTURE

BACKGROUND OF THE INVENTION

This invention relates to devices for controlling the exchange of air through openings of refrigerated fixtures.

Frozen or refrigerated goods, particularly frozen or refrigerated foods, for use in restaurants or other cold storage facilities are typically stored in refrigerated fixtures which include one or more doors which pivot open. The doors provide access to the refrigerated fixtures. However, these doors are kept open continuously during peak periods when restaurant personnel need to remove frozen food from the fixture. Also, when the doors are kept open at least a substantial portion of the time they tend to get in the way of restaurant personnel.

Many attempts have been made to reduce the air exchange at the open refrigerated fixture doors. One common approach has been to use an air curtain across the door with the forced flow of relatively high velocity air across the opening serving both to restrict the normal air exchange resulting from the temperature differential and to mix or dilute any air which does pass through the air curtain. Examples of such devices are disclosed in U.S. Pat. Nos. 3,218,952 and 3,817,160. However, the doors still are in the way of restaurant personnel.

Physical barriers, particularly strip doors, are also used to restrict the flow of air through an open refrigerated fixture door. Strip doors employ transparent vinyl strips which enable personnel to push through, with the strips falling back into place to act as an air flow barrier when the personnel has cleared the door. Strip doors tend to become less transparent with use and present an obstruction to vision.

It would therefore be advantageous to have a refrigerated fixture which both restricts the air flow between the interior of the rerigerated fixture and the ambient air outside the refrigerated fixture and which has one or more doors which do not get in the way of the personnel using the refrigerated fixture.

SUMMARY OF THE INVENTION

Among the objects of the present invention is the provision of an energy conserving refrigerated fixture which is of simple construction for low cost and highly reliable operation; the provision of such an energy conserving refrigerated fixture that can be easily incorporated into new refrigerated fixtures; the provision of such an energy conserving refrigerated fixture which occupies a minimum of floor space; and the provision of such an energy conserving refrigerated fixture which reduces the flow of cold air from the refrigerated fixture.

Generally, the energy conserving refrigerated fixture has an opening for enabling access to the interior of the fixture and comprises track members adapted to be mounted in contact with the opening, a sectional door mounted between the track members for sliding movement between a closed position and an open position, refrigeration means for providing refrigerated air, means for circulating the refrigerated air, air outlet means disposed around the opening, and means, connected to the circulating means, for operating the circulating means when the door contacts the operating means.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
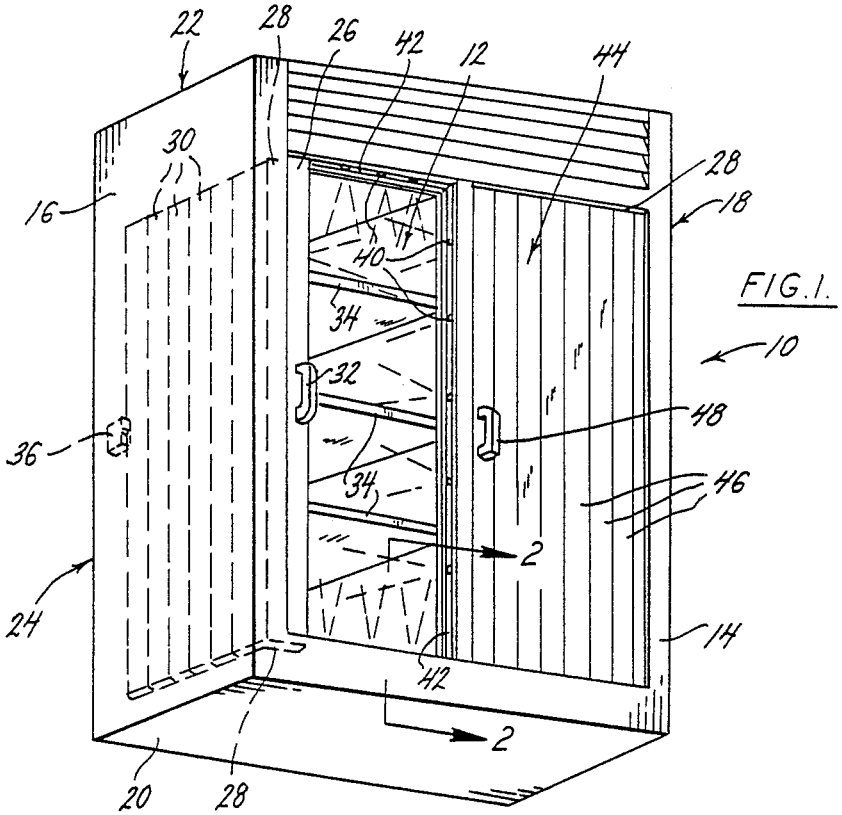
FIG. 1 is a perspective view of an energy conserving refrigerated case of the present invention.

Referring now to FIG. 1, a refrigerated fixture of the present invention is indicated generally by the reference character 10 in the drawings. The fixture 10 has an excess opening 12 formed in a front side 14 of the fixture 10. The fixture 10 also includes a left side 16, a right side 18, a bottom side 20, a top side 22, and a back side 24, all of which are connected together to form the fixture 10. A first door 26 is positioned on a pair of arcuate track members 28 (shown in phantom) in the access opening 12 for sliding movement between a closed position and an open position. The first door 26 comprises similarly shaped door sections 30. The first door 26 also includes a handle 32 for opening and closing the door 26.

When the first door 26 is open access to the interior of the fixture 10 is through the access opening 12. The interior of the fixture 10 includes shelves 34 for storing frozen food. Additionally, when the first door 26 is opened, it contacts a switch 36 (shown in phantom) which operates a motor driven fan 38 (FIG. 4) for circulating refrigerated air through nozzles 40 located in frame members 42 which form the access opening 12. The refrigerated air is discharged from the nozzles 40 in a stream which forms a barrier in the access opening 12 which results in keeping the interior of the fixture 10 refrigerated during extended periods of time when the first door 26 is open. The fixture 10 also includes a second door 44 which is mounted within the fixture 10 in the same manner as the first door 26. The second door 44 slides along arcuate track members 28 between a closed position and an open position. The second door 44 also contacts a switch (not shown) which operates a fan (not shown) to discharge air through nozzles (also not shown). The second door 44 is comprised of door sections 46 and also has a handle 48.

Figure 2:
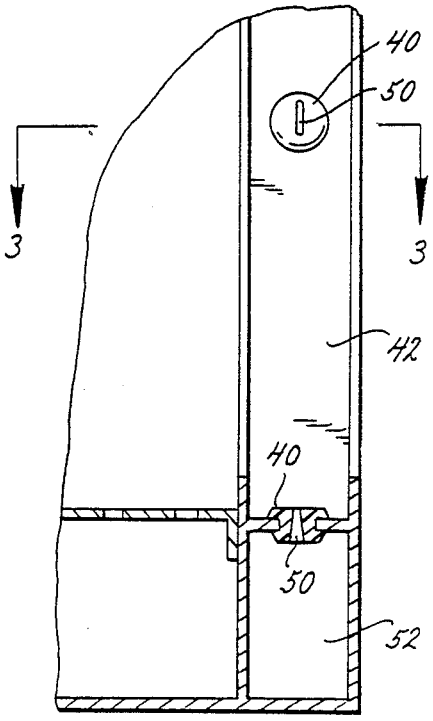
FIG. 2 is an enlarged partial cross-sectional view taken along the line 2—2 of FIG. 1.

The nozzles 40 are illustrated in FIG. 2. The nozzles 40 have a central opening 50 which allows refrigerated air which flows within a channel 52 of the frame member 42 to be discharged.

Figure 3:
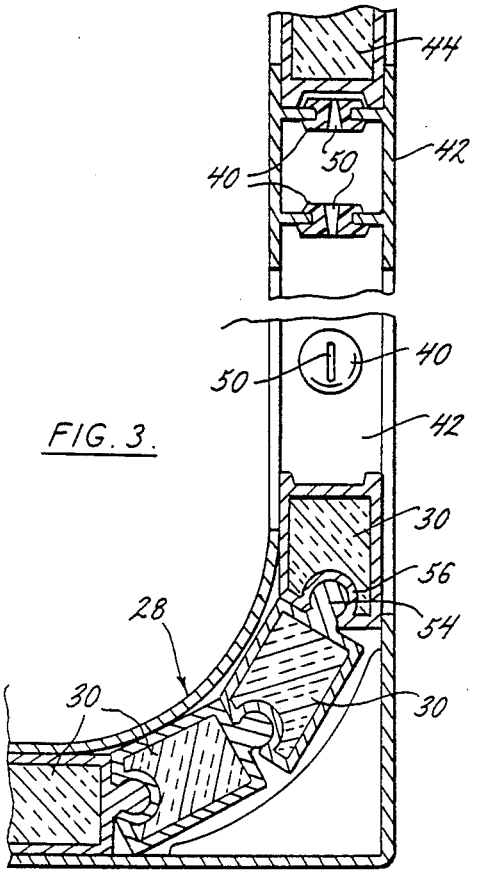
FIG. 3 is an enlarged partial cross-sectional view taken along the line 3—3 of FIG. 2.

FIG. 3 illustrates the arcuate track members 28. The first door 26 is mounted within the arcuate track members 28. The door sections 30 are also shown to include a ball 54 which fits into a socket 56 of an adjacent door section 30. The section construction of the first door 26 allows for sliding the first door 26 within the track members 28. As can be appreciated, the first door 26 slides into the left side 16 and out of the way of anyone trying to access the frozen food stored in the interior of the fixture 10. One of the nozzles 40 is also shown within the arcuate track member 28. One of the frame members 42, which is located at the center of the access opening 12, includes nozzles 40 which discharge refrigerated air into the access opening 12 which is present once the first door 26 is opened and into the access opening 12 which is present once the second door 44 is opened. The second door 44 is shown closed in FIG. 3.

Figure 4:
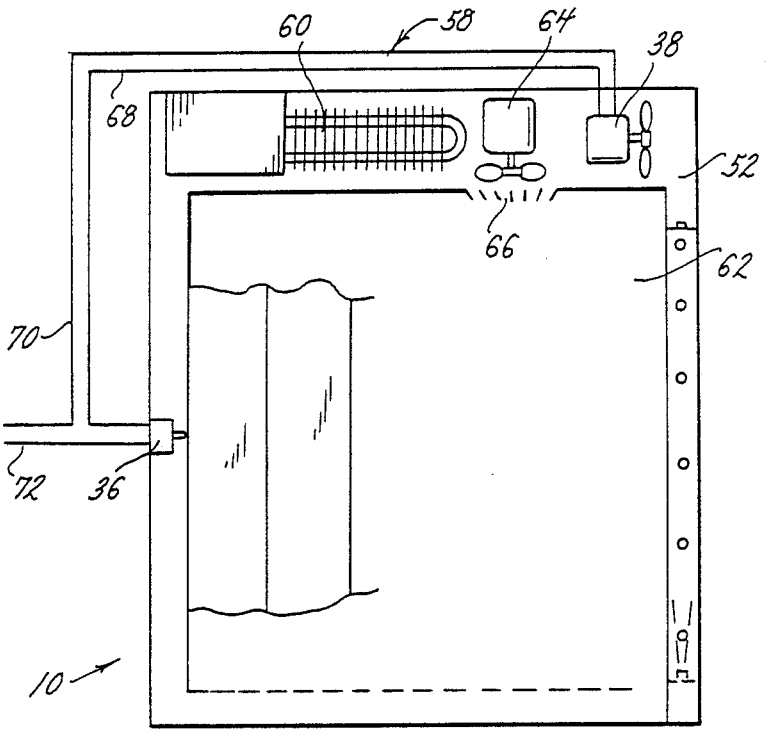
FIG. 4 is a fragmentary schematic view of the energy conserving refrigerated case of FIG. 1.

The refrigeration components 58 of the fixture 10 are illustrated in FIG. 4. An evaporator coil 60 provides refrigerated air to both the interior 62 of the fixture 10 and to the channels 52 of the frame members 42. A fan 64 circulates refrigerated air through an opening 66 in the interior 62 of the fixture 10. The fan 38 is connected to the switch 36 via a line 68. The fan 38 is connected to a power source (not shown) via a line 70 and the switch 36 is connected to the power source via a line 72. When the first door 26 contacts the switch 36 power is supplied to the fan 38 to circulate refrigerated air through the channels 52 of the frame members 42 to be discharged through the nozzles 40. The switch 36 is shown that it is actuated when the first door 26 is fully opened. However, the switch 36 can be placed at other positions along the arcuate track members 28.

Figure 5:
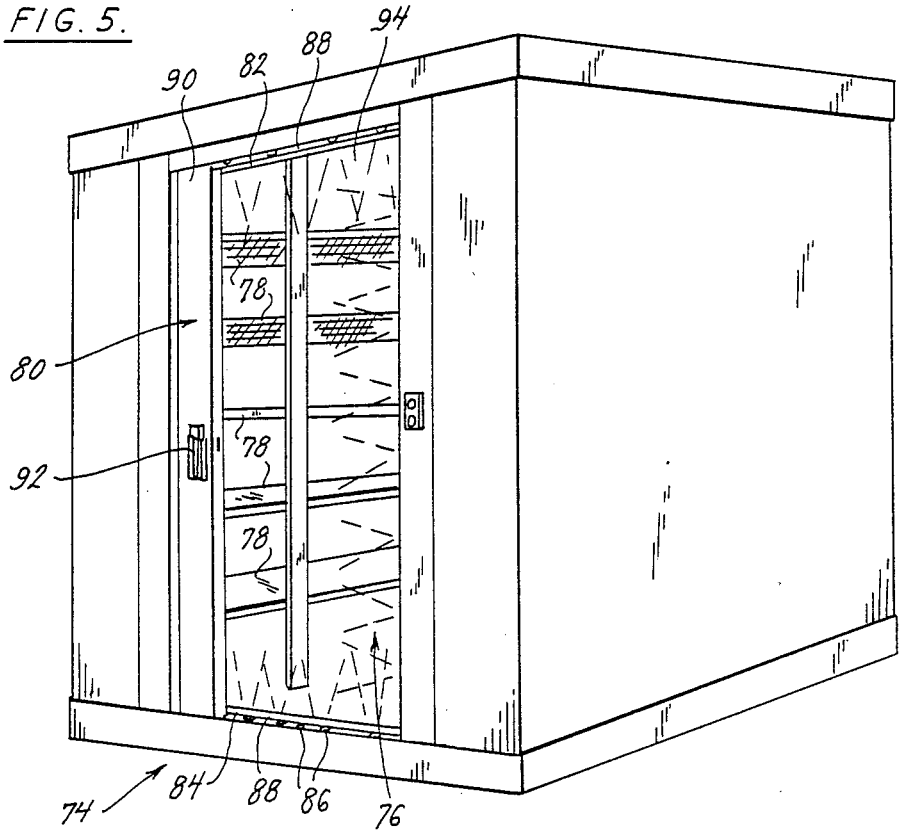
FIG. 5 is a perspective view of a second energy conserving refrigerated case according to the present invention.

FIG. 5 shows a second fixture 74 which is large enough to allow personnel to enter into the interior 76 of the fixture 74 to remove frozen food stored on shelves 78. The fixture 74 includes a single door 80 which is mounted between a pair of arcuate track members 82 and 84 for sliding movement between a closed position and an open position. When the door 80 is opened, the door 80 contacts a switch (not shown) which operates a fan (not shown) for circulating refrigerated air through nozzles 86 located in frame members 88. The door 80 comprises door sections 90 and a handle 92. The refrigerated air is discharged from the nozzles 86 in a stream which forms a barrier in an access opening 94 which results in keeping the interior 76 of the fixture 74 refrigerated during extended periods of time when the door 80 is open.

It is also contemplated that the teachings of the present invention are also suitable for use in commercial ice machines. The sectional door, arcuate track members, and the nozzles of the present invention could be incorporated in commercial ice machines to keep the ice frozen even during extended periods of time when the door is open.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A refrigerated fixture having an opening for enabling access to the interior of the fixture, the fixture comprising:

track members adapted to be mounted in contact with the opening;

a sectional door mounted between the track members for sliding movement between a closed position and an open position;

refrigeration means for providing refrigerated air;

means for circulating the refergerated air comprising a fan;

air output means disposed around the opening; and means, connected to the circulating means, for operating the circulating means when the door contacts the operating means comprising a switch which when contacted by the door operates the fan.

2. The fixture of claim 1 wherein the track members are arcuate track members.

3. The fixture of claim 1 wherein the sliding door, when in the open position, is within the interior of the fixture.

4. The fixture of claim 1 wherein the sliding door slides in the track members.

5. The fixture of claim 1 wherein the air outlet means comprises nozzle means adapted to discharge the refrigerated air in a stream which forms a barrier in the opening.

6. The fixture of claim 5 wherein the nozzle means comprises a nozzle including a central opening which allows the refrigerated air from the circulating means to be discharged in the opening.

7. The fixture of claim 1 wherein the sectional door comprises similarly shaped door sections including a ball which fits into a socket of an adjacent door section.

8. The fixture of claim 1 further comprising a second sectional door mounted between the track members.

9. A refrigerated fixture having an opening for enabling access to the interior of the fixture, the fixture comprising:

track members adapted to be mounted in contact with the opening and a sided of the fixture;

a sectional door mounted between the track members for sliding movement between a closed position and an open position;

refrigeration means for providing refrigerated air;

means for circulating the refrigerated air comprising a fan;

air outlet means disposed around the opening; and means, connected to the circulating means, for operating the circulating means when the door contacts the operating means comprising a switch which when contacted by the door operates the fan.

10. The fixture of claim 9 wherein the track members are arcuate track members.

11. The fixture of claim 9 wherein the sliding door, when in the open position, is within the interior of the fixture.

12. The fixture of claim 9 wherein the sliding door slides in the track members.

13. The fixture of claim 9 wherein the air outlet means comprises nozzle means adapted to discharge the refrigerated air in a stream which forms a barrier in the opening.

14. The fixture of claim 13 wherein the nozzle means comprises a nozzle including a central opening which allows the refrigerated air from the circulating means to be discharged in the opening.

15. The fixture of claim 9 wherein the sectional door comprises similarly shaped door sections including a ball which fits into a socket of an adjacent door section.

16. The fixture of claim 9 further comprising a second sectional door mounted between the track members.

* * * * *